US007505368B2

(12) United States Patent
Hamilton

(10) Patent No.: US 7,505,368 B2
(45) Date of Patent: Mar. 17, 2009

(54) MISSILE DEFENSE SYSTEM

(75) Inventor: Colin Hamilton, Blaustein (DE)

(73) Assignee: EADS Deutschland GmbH, Ottobrunn (DE)

( * ) Notice: Subject to any disclaimer, the term of this patent is extended or adjusted under 35 U.S.C. 154(b) by 66 days.

(21) Appl. No.: 11/700,039

(22) Filed: Jan. 31, 2007

(65) Prior Publication Data

US 2008/0117718 A1 May 22, 2008

(30) Foreign Application Priority Data

Feb. 1, 2006 (DE) ..... 10 2006 004 517

(51) Int. Cl.
*F41H 11/02* (2006.01)

(52) U.S. Cl. ..... 367/137

(58) Field of Classification Search ..... 367/1, 367/137, 138; 89/1.11, 1.13; 102/200, 210, 102/211

See application file for complete search history.

(56) References Cited

U.S. PATENT DOCUMENTS

| | | | | |
|---|---|---|---|---|
| 4,557,437 | A | 12/1985 | Seidensticker et al. | |
| 7,206,257 | B1 * | 4/2007 | Meng | 367/137 |
| 2008/0117718 | A1 * | 5/2008 | Hamilton | 367/137 |

FOREIGN PATENT DOCUMENTS

| | | | |
|---|---|---|---|
| DE | 22 50 630 | | 10/1972 |
| DE | 21 26 931 | A1 | 11/1972 |
| DE | 31 30 930 | A1 | 8/1981 |
| DE | 33 01 663 | A1 | 1/1983 |
| DE | 33 45 352 | A1 | 6/1985 |
| DE | 36 02 589 | C1 | 1/1986 |
| DE | 196 01 756 | C1 | 1/1996 |
| DE | 101 55 151 | A1 | 5/2003 |
| EP | 0 149 778 | A2 | 12/1984 |
| EP | 1816430 | A1 * | 8/2007 |
| GB | 2 240 384 | A | 7/1991 |
| GB | 2 392 487 | A | 3/2004 |
| JP | 2001 221595 | A | 8/2001 |
| WO | WO 2004/024559 | A2 | 3/2004 |

OTHER PUBLICATIONS

Rafael, "ASPRO-A (Trophy)", 2006.*

European Search Report dated May 24, 2007 with English translation of relevant portion (five (5) Pages).

"Directional Infrared Counter Measures", Wikipedia, the Free Encyclopedia, (online), URL:Http://en.wikipedia.org/wiki/Directional Infrared Counter Measures.

"AN/AAQ-24 Directional Infrared Countermeasures (DIRCM)", GlobalSecurity.org, Internet article, Apr. 27, 2005, URL:http://www.globalsecurity.org/military/systems/aircraft/systems/an-aag-24.htm. XP-002498702.

"AN/AAQ-24(V) Nemesis Directional Infrared Countermeasure (DIRCM)", Northrop Grumman Product & Solutions Brochure, URL:http://www.es.northropgrumman.com/solutions/nemesis/assets/AAQ24.pdf. XP002498703.

European Search Report dated Oct. 27, 2008 including English translation of the relevant portion (Twenty-two (22) pages).

* cited by examiner

*Primary Examiner*—Dan Pihulic
(74) *Attorney, Agent, or Firm*—Crowell & Moring LLP

(57) ABSTRACT

In a method and apparatus for defense against missiles that have explosive substances and piezoelectric detonators, the detonator of the missile is excited by ultrasonic radiation, causing it to oscillate and thus be triggered in flight.

13 Claims, 2 Drawing Sheets

MISSILE DEFENSE SYSTEM

BACKGROUND AND SUMMARY OF THE INVENTION

This application claims the priority of German patent document 102006004517.3-15, filed Feb. 1, 2006, the disclosure of which is expressly incorporated by reference herein.

The invention relates to a method and an apparatus for defense against missiles that have explosive substances with piezoelectric detonators.

Piezoelectric sensors are frequently used as percussion detonators for triggering explosive payloads in unguided missiles, (for example, rockets or shells). One such missile is the Russian RPG-7 anti-tank grenade, shown in FIG. 1.

This weapon, which is widely used, is responsible for a large number of casualties in the present-day asymmetrical war scenarios. The main defense against such weapons is armor. However, armor is not always effective against the powerful plasma beam generated by a shaped charge.

Active defense systems that attempt to shoot down the missile in flight have been proposed. These are, however, very expensive, have only a low hit probability, and cannot be used where the missile is launched close to the target. Defense systems based on microwave energy are not suitable because the rocket housing forms a shield against the electromagnetic radiation that can be overcome only by extreme power levels.

German patent document DE 22 50 630 B2 discloses a remote triggering systems that uses ultrasonic signals to detonate explosive charges underwater. An ultrasonic receiver, which is assigned to an explosive charge, receives the ultrasonic signal, converts it to an electrical signal and subjects it to further processing. The output signal of the ultrasonic receiver is applied to an electrical detonator to trigger the detonation.

One object of the present invention is to provide a method and a system that enables a very reliable defense against missiles.

These and other objects and advantages are achieved by the method and apparatus according to the invention, in which ultrasonic radiation is emitted to counter the incoming missile. Such radiation causes the piezoelectric detonator of the incoming missile to oscillate and thus triggers the detonator that was activated after the launch of the missile. The explosive payload is thus triggered far from the target during the approach of the missile.

The emitted ultrasonic radiation, which can be directed or undirected can penetrate the metal casing of the missile with only slight attenuation. Directed emission of ultrasonic energy is preferably in the form of a high-energy beam with a small angle of aperture. For this purpose, an array of several ultrasonic transducers is preferred, which permits the emitted energy to be aligned by appropriate phase control of the signals of the individual ultrasonic transducers (phased-array technique). Alignment is therefore by purely electronic means without moving mechanical parts.

Alternatively, however, mechanical control of the alignment, such as is used with radar systems, can be provided. For example, the ultrasonic generator may be mounted on a turntable that can be adjusted in azimuth and elevation.

A combination of electronic and mechanical alignment is also possible. For example, a turntable may be used for the azimuth alignment, while alignment in elevation is carried out electronically by means of an array (or in its simplest form by means of a line) of ultrasonic generators.

The frequency of the ultrasonic radiation is preferably chosen so that the piezoelectric detonator of the incoming missile is excited at its natural resonant frequency or a harmonic or subharmonic thereof.

To compensate for tolerances in the known resonant frequency of the detonator or uncertainties with regard to the precise value of the resonant frequency of the detonator, the emitted ultrasonic frequency can be varied over a certain frequency range, e.g., by linear frequency modulation.

Furthermore the Doppler shift that occurs due to the relative speeds of the missile and the platform transmitting the ultrasonic radiation can also be advantageously taken into account in the choice of emitted ultrasonic frequency. Also in this connection, the frequency of the ultrasonic radiation can be varied to compensate for uncertainties with respect to the exact value of the Doppler frequency.

With the method according to the invention, a reliable and cost-effective defense against missiles is realized. Direct hits by the missiles, and thus the formation of destructive plasma jets in the direct vicinity of the target, can be avoided.

The method according to the invention is suitable for defense against all guided and unguided missiles, e.g., rockets or shells.

A system for implementing the method according to the invention includes the following main components.

a) A missile warning sensor for detecting the launch of the enemy missile. Known missile warning sensors based on IR, UV or radar sensors can be used for this purpose. The software of the warning sensor is advantageously tuned to the specific signature of the relevant missile.

b) A tracking sensor for tracking the incoming missile. This may be either the same sensor as the missile warning sensor or an additional sensor. For instance, a passive electro-optical sensor based on a UV sensor can be used. Because of the limited burn time of the missile, the use of an IR sensor is preferred. An active radar sensor is quite particularly suitable because the method according to the invention can be most effectively implemented on the basis of range information.

c) A positioning device or aligning the ultrasonic beam on the incoming missile. The alignment takes place in such a way that the travel time of the ultrasonic beam to the target is allowed for.

A rotating turntable that enables the radiation to be mechanically set in azimuth and elevation can be used for this purpose, for example. The alignment can also take place by purely electronic means in that the phases of the individual ultrasonic generators of a two-dimensional array are suitably controlled. Electronically controlled acoustic arrays such as are known for example from sonar systems for underwater applications can be used for this purpose.

d) A device for generating ultrasonic waves. Devices that are suitable for generating a high-energy, narrowly focused ultrasonic beam with a high energy density are preferred for this purpose. Two-dimensional arrays consisting of single acoustic radiators are especially suited to this purpose. Their frequency is, for example, set to the resonant frequency of the piezoelectric detonator of the RPG-7 anti-tank grenade. The alignment of the emitted ultrasonic energy in azimuth and elevation takes place (as already explained in item (c) above, electronically or mechanically, or by a combination of electronic and mechanical means.

The described method can be carried on aircraft or on land vehicles. Stationary on-ground applications are also possible. A particular advantage of the system according to the invention is its very short reaction time, which is particularly important when under close-range bombardment.

Other objects, advantages and novel features of the present invention will become apparent from the following detailed description of the invention when considered in conjunction with the accompanying drawings.

DETAILED DESCRIPTION OF THE DRAWINGS

Figure 1:
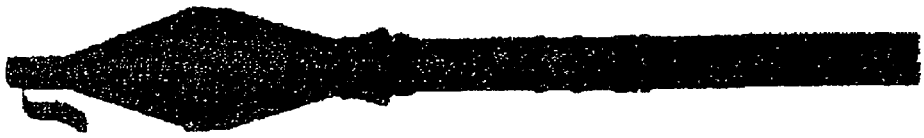
FIG. 1 shows an RPG-7 anti-tank grenade of the type described above.
Figure 2:
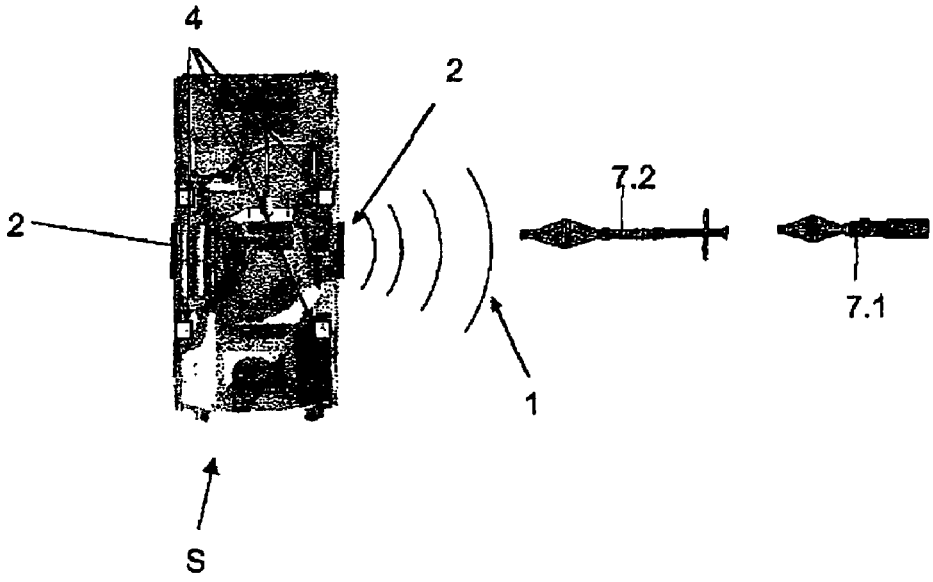
FIG. 2 is a side elevation of a system for implementing the method according to the invention.

A system S for implementing the method according to the invention, shown schematically in FIG. 2, includes an array 2 that has several ultrasonic transducers arranged on opposite parallel side surfaces. This device makes possible protection against incoming missiles in large parts of the left and right hemisphere. If necessary, further transducers can be added in order to achieve full 360° coverage. Both ultrasonic arrays 2 are rigidly mounted on the surface of the system S. In the embodiment shown, the ultrasonic radiation 1 is aligned with the incoming missile 7.2 by purely electronic means, by suitable phase control of the individual ultrasonic transducers of an array 2. An additional (e.g., mechanical) positioning device is not necessary in this case.

The system also includes four electro-optical missile warning sensors 4 for detection of the launch of the enemy missile. (Reference numeral 7.1 shows the missile in the launch phase.) A 360° coverage is possible with the four missile warning sensors 4 shown, which are in this case also used as tracking sensors for tracking the incoming missile.

The system shown in FIG. 2 is a very compact easy-to transport unit.

Figure 3:
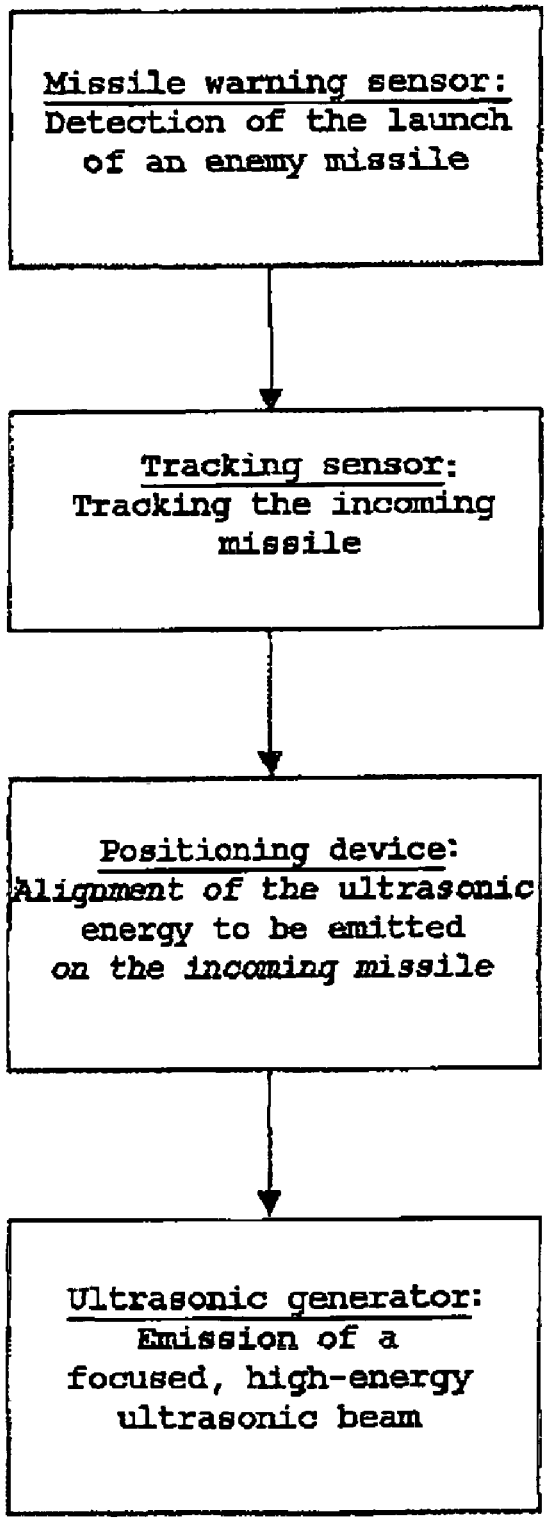
FIG. 3 is a flow diagram that shows the implementation of the method.

FIG. 3 is a flow diagram, which illustrates the steps for implementing the method according to the invention. The launch of an enemy missile, e.g., an RPG-7 anti-tank grenade, is detected in step 301, by the missile warning sensors. The tracking sensor (the function of which in this case is performed by the missile warning sensors) then takes over the tracking of the incoming missile (step 302). The ultrasonic energy to be emitted is aligned on the missile by means of the positioning device in step 303. Alignment includes taking account of the propagation time of the ultrasonic beam to the target. The generation and directed emission of the ultrasonic energy in the form of a focused high-energy acoustic beam then takes place in step 304. Where there is purely electronic alignment, the alignment and emission functions of the ultrasonic radiation take place together.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for defending against missiles that have explosive substances with piezoelectric detonators, said method comprising:

using ultrasonic radiation to excite a detonator of the missile, causing it to oscillate and thus be triggered in flight.

2. The method according to claim 1, wherein said ultrasonic radiation has a frequency that is one of a natural resonant frequency of the piezoelectric detonator and a harmonic or subharmonic of said resonant frequency.

3. The method according to claim 1, further comprising varying the frequency of the ultrasonic radiation to compensate for tolerances in the known resonant frequency of the detonator and uncertainties with regard to an exact value of the resonant frequency of the detonator.

4. The method according to claim 1, wherein the frequency of the ultrasonic radiation is chosen taking account of a Doppler frequency based on one of speed of the missile and speed of the platform transmitting the ultrasonic radiation.

5. The method according to claim 4, wherein the frequency of the ultrasonic radiation is varied to compensate for uncertainties with regard to an exact value of the Doppler frequency.

6. The method according to claim 1, wherein emission of the ultrasonic radiation is directed.

7. The method according to claim 1, wherein the ultrasonic radiation is emitted in the form of a high-energy beam with a small angle of aperture.

8. The method according to claim 7, wherein the ultrasonic radiation is aligned electronically, using phased-array technology.

9. The method according to claim 1, wherein emission of the ultrasonic radiation is undirected.

10. A system for defense against a missile having an explosive substance and a piezoelectric detonator, said system comprising:

a missile warning sensor for detecting launch of a missile;

a tracking sensor for tracking the missile;

a device for generating ultrasonic radiation suitable for exciting said detonator, causing it to oscillate, and thus to be triggered in flight; and a positioning device for aligning the ultrasonic radiation on the incoming missile.

11. A method for defending against an incoming missile that includes an explosive material and a piezoelectric detonator, said method comprising:

detecting said incoming missile;

generating an ultrasonic radiation field; and directing said ultrasonic radiation field to impinge on said missile;

wherein said ultrasonic radiation field has a frequency that is selected from the group consisting of a natural resonant frequency of the piezoelectric detonator, a harmonic of said resonant frequency and a subharmonic of said resonant frequency.

12. The method according to claim 11, wherein the frequency of the ultrasonic radiation is chosen taking account of a Doppler frequency based on one of speed of the missile and speed of the platform transmitting the ultrasonic radiation.

13. The method according to claim 12, wherein the frequency of the ultrasonic radiation is varied to compensate for uncertainties with regard to an exact value of the Doppler frequency.

* * * * *